US006841326B2

(12) United States Patent
Arai et al.

(10) Patent No.: US 6,841,326 B2
(45) Date of Patent: Jan. 11, 2005

(54) TONER CONTAINING SPECIFIC EXTERNAL ADDITIVE FOR FULL COLOR-COPYING MACHINE AND FIXING METHOD OF THE SAME

(75) Inventors: Takeshi Arai, Akashi (JP); Masahiro Anno, Sakai (JP); Chikara Tsutsui, Nishinomiya (JP); Minoru Nakamura, Takarazuka (JP); Yoshitaka Sekiguchi, Nishinomiya (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 10/375,151

(22) Filed: Feb. 28, 2003

(65) Prior Publication Data

US 2003/0165761 A1 Sep. 4, 2003

(30) Foreign Application Priority Data

Mar. 4, 2002 (JP) ..... 2002-057168
Mar. 8, 2002 (JP) ..... 2002-063142

(51) Int. Cl.[7] ..... G03G 9/08; G03G 13/01

(52) U.S. Cl. ..... 430/108.6; 430/108.7; 430/124

(58) Field of Search ..... 430/108.6, 108.7, 430/124, 108.1, 45

(56) References Cited

U.S. PATENT DOCUMENTS 5,981,132 A 11/1999 Kurose et al.
6,287,739 B1 9/2001 Kawakami et al.
6,338,929 B1 * 1/2002 Hagi et al. ..... 430/108.4
6,635,398 B1 * 10/2003 Komoto et al. ..... 430/108.23

FOREIGN PATENT DOCUMENTS

JP 2001-356515 12/2001

* cited by examiner

*Primary Examiner*—John L Goodrow
(74) *Attorney, Agent, or Firm*—Burns, Doane, Swecker & Mathis, L.L.P.

(57) ABSTRACT

The present invention relates to toners for full color image-forming machine with specific external additives (kind, BET specific surface area etc.) added externally in combination to toner particles prepared by a wet granulation method, and a fixing method suitable for the toner.

20 Claims, 1 Drawing Sheet

TONER CONTAINING SPECIFIC EXTERNAL ADDITIVE FOR FULL COLOR-COPYING MACHINE AND FIXING METHOD OF THE SAME

This application is based on applications No. 2002-057168 and 2002-063142 filed in Japan, the contents of which are hereby incorporated by reference.

BACKGROUND OF THE INVENTION

1. Field of the Invention

The present invention relates to a toner used in an image-forming apparatus such as a copy machine, a printer, a facsimile or the like, and to an image-forming method using such a toner.

2. Description of the Related Art

Toner utilized in image-forming apparatuses using electrophotography or the like has conventionally been manufactured according to a kneading and pulverizing method wherein materials such as a binder resin and a coloring agent, and a charge controlling agent and a wax, if necessary, are melted and kneaded, and the resultant mixture is pulverized and classified.

In recent years the demand for image-forming apparatuses that can produce higher quality images has increased and a toner having small particle size and having a sharp particle-size-distribution, which enable higher image quality, has come to be required. In addition, in an image-forming apparatus for forming a full color image using toners of a plurality of colors, a fixing member such as a heat roller and a pressure roller is applied with or impregnated with fixing oil such as silicone oil. Thereby, an offset phenomenon is prevented and the property of release of recording paper from the fixing member is secured. However, the demand for miniaturization and for cost reduction of full color image-forming apparatuses has increased and the adoption of an oilless fixing apparatus wherein a fixing oil application mechanism etc. is not necessary has been desired.

In the case of the manufacture of a toner according to the conventional kneading and pulverizing method, there is a problem wherein manufacturing costs increase as the particle size of the toner becomes smaller and as the distribution of particle size becomes sharper. In addition, though it is necessary to include a wax in the toner in order to be applied to oilless fixing, waxes conventionally utilized, such as polyethylene wax, polypropylene wax, paraffin wax, carnauba wax and ester wax, are not compatible with a binder resin. There is a problem wherein it is difficult to add a large amount of wax to the toner because the wax is isolated at the time of pulverization when a toner is manufactured according to the kneading and pulverizing method.

On the other hand, a manufacturing method for toner using a wet granulation method, such as a suspension polymerization method, a dispersion polymerization method, a resin particle association method or an emulsification dispersion method, has been focused on as a manufacturing method that can provide, at a low cost, a toner with a small particle size and a sharp distribution of particle size. Such wet granulation methods do not require a pulverizing process, such as the kneading and pulverizing method, They have such an advantage that a large amount of wax can be added to the toner so as to be applied to oilless fixing.

When a toner for full color is produced by a wet granulation method, there arises such a problem that the difference of quantity of electro static charge among each color toner becomes large depending on the difference of colorants used, when compared to the toner prepared by the kneading and pulverizing method. When a toner is prepared by the kneading and pulverizing method, it is relatively easy to control quantity of electro static charge by selecting kinds of charge-controlling agent and addition amount. However, in the case of a wet granulation method, the charge controlling agent causes a factor to prevent granulation of toner particles, or a quantity of electro static charge corresponding to the amount of addition is not necessarily achieved. Therefore, it is difficult to control an electrical amount of each color toner.

In addition, in the case that a toner image formed on a photosensitive member, which is an electrostatic latent image-support member, is transferred to a medium to be transferred using a transfer roller, pressure is applied to the toner image on the photosensitive member by means of the transfer roller. There is a problem of the partial adhesion between the toner image and the photosensitive member, resulting in that the toner is prevented from shifting to the medium to be transferred to form image lacking (hollow defects). In general, though a wet granulated toner is uniform in form and has a smooth surface in comparison with a pulverized toner, adhesion of the toner to the photosensitive member is strong so that the problem of hollow defects at the time of transfer becomes significant. In particular, in a full color image-forming apparatus wherein an intermediate transfer belt is adopted, a full color image is formed through primary transfer wherein a toner image formed on a photosensitive member, which is an electrostatic latent image-support member, is transferred to a intermediate transfer belt using a transfer roller, and through secondary transfer wherein a full color toner image, formed of toner images of the respective colors overlapped on the intermediate transfer belt, is transferred to recording paper using a transfer roller. In such a full color image-forming apparatus, as the primary transfer of a toner image on a photosensitive member, as well as secondary transfer of a full color toner image on an intermediate transfer belt, is carried, it is further necessary to solve the problem of hollow defects.

SUMMARY OF THE INVENTION

The present invention is to provide toners in which the difference of quantity of electro static charge among each color toner particles prepared by a wet granulation method is small.

Another purpose of the present invention is to provide a toner having no problem of hollow defects in copied images at the time of pressure transfer without affecting adversely the chargeability.

The present invention is also to provide a toner having excellent chargeability even when a charge controlling agent (CCA) is not used.

The present invention is also to provide a toner having no problem on heat-resistant storage property relating to a toner for oilless fixing without adverse effects to cleaning properties.

The present invention is to provide toners with specific external additives added in combination to toner particles externally, and a fixing method suitable for the toner.

DETAILED DESCRIPTION OF THE INVENTION

Figure 1:
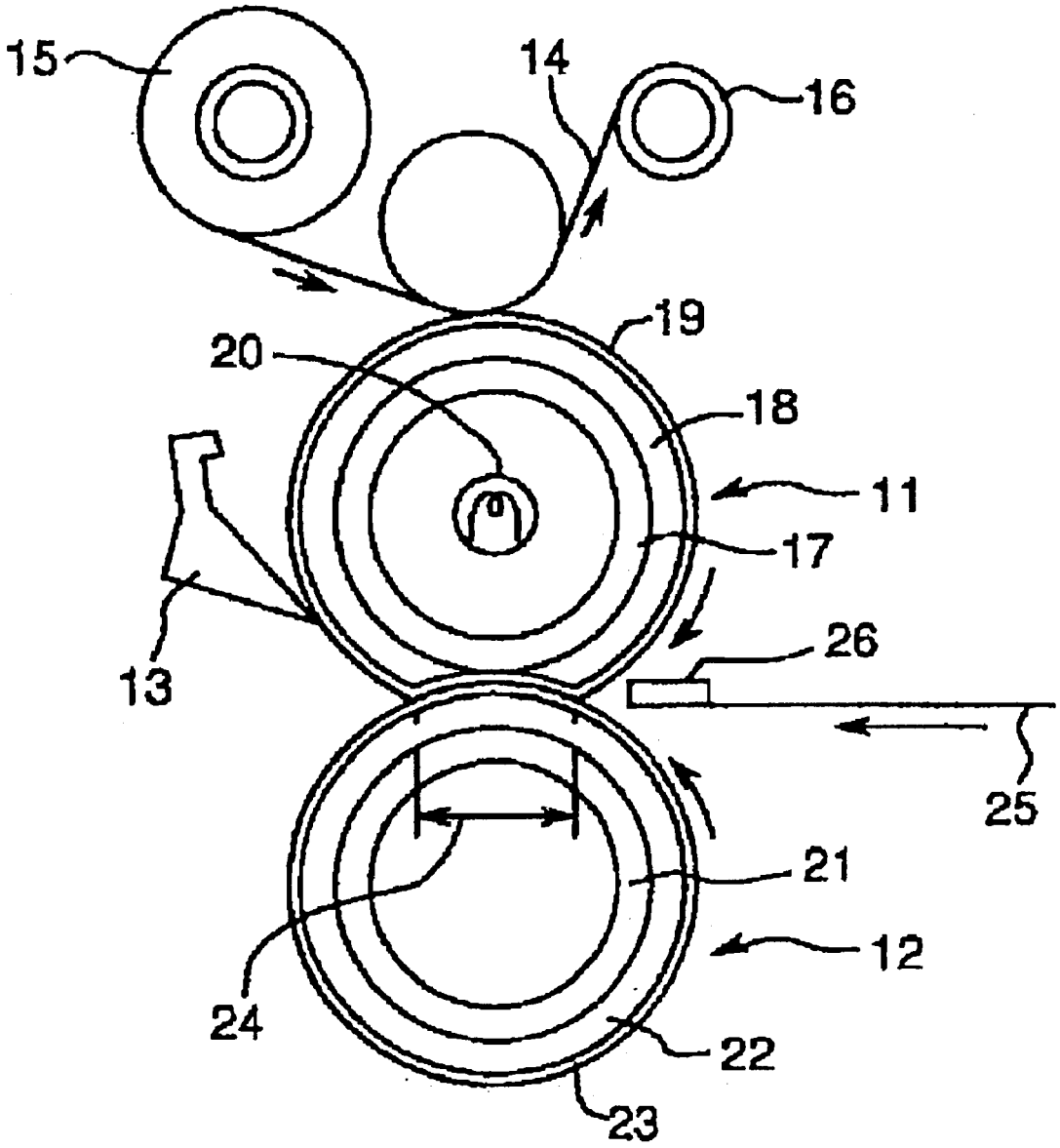
FIG. 1 is a schematic structural diagram showing one example of a fixing device in which a fixing method of the present invention is used.

The present invention provides a toner for full color used in a full color image-forming apparatus, containing toner particles and external additives added externally to the toner particles, in which the toner particles are prepared by a wet granulation method to have a volume mean particle size of 3–7 μm, a total amount of addition of the external additive is within the range of 2.1–5.5 parts by weight to 100 parts by weight of the toner particles and a BET specific surface area is within the range of 2.0–4.0 $m^2/g$ after the external additive is added to the toner particles.

The present invention also provides to a fixing process in which a recording medium with toner images formed thereon is allowed to pass through a press-contact portion between a heating member (having a surface layer of fluorine-containing resin and an elastic material layer) and a pressure member or a pressure heat-applying member that is made in press-contact with the heating member to be fixed and the toner images being constituted by the above toner.

The present invention relates to a toner containing toner particles and external additives added externally to the toner particles, in which the toner particles are prepared by a wet granulation method, and contain as the external additives first inorganic fine particles that are surface-treated by a hydrophobizing agent to have a BET specific surface area of 150 to 300 $m^2/g$ after surface treatment, second inorganic fine particles that are surface-treated by a hydrophobizing agent to have a BET specific surface area of 30 to 100 $m^2/g$ after surface treatment and third inorganic fine particles having a BET specific surface area of 3 to 20 $m^2/g$, and a total specific surface area of the external additive being set to 200 to 530 $m^2/g$ with respect to 100 parts by weight of the toner particles.

The present invention also provides to a fixing process in which a recording medium with toner images formed thereon is allowed to pass through a press-contact portion between a heating member (having a surface layer of fluorine-containing resin and an elastic material layer) and a pressure member or a pressure heat-applying member that is made in press-contact with the heating member to be fixed and the toner images being constituted by the above toner.

A toner of the present invention comprises toner particles gained by means of a wet granulation method and external additives which are externally added to the toner particles. In the present specification "external additive" means fine particles added to a toner so as to exist outside of (on the surfaces of) the toner particles gained in advance by means of a wet granulation method.

As for the toner particles, toner particles that are manufactured by means of a wet granulation method, such as a suspension polymerization method, a dispersion polymerization method, a resin particle association method or an emulsification dispersion method are used By manufacturing toner particles by means of such a method, it becomes possible to provide toner particles having a small particle size and having a sharp distribution of particle size in comparison with a pulverizing method. A suspension polymerization method and a resin particle association method are preferable among the wet granulation method. A resin particle association method is preferable from the point of view of freedom of control of toner particle form.

A resin particle association method is a method for manufacturing toner particles by means of coagulation (salting out) of particles in a particle dispersion solution in which particles, including at least resin particles, are dispersed, and by heating and fusing the particles gained by coagulation. A method for coagulation from a mixture mixed at the time of coagulation with dispersions such as a coloring agent, which is a toner component, and a wax and a charge control agent, if necessary, or a method for emulsion polymerization after dispersion of toner components, such as a coloring agent and a wax, in a monomer forming resin particles can be cited. Preferably, resin particles, coloring agent particles and wax particles are coagulated in an aqueous medium and then fused. It is preferable to utilize resin particles having a mean particle size of 50 nm to 1000 nm. Therefore, it is preferable to prepare resin particles by means of an emulsion polymerization method that can give fine particles.

With respect to coagulation (salting out) and fusion of particles including at least resin particles, fusion may be carried out after formation of coagulated primary particles or fusion may be carried out simultaneously with coagulation (salting out). In the latter case, a salting agent containing an alkali metal salt or an alkali earth metal salt is added to water wherein at least resin particles, coloring agent particles and wax particles, for example, are dispersed at a critical coagulation concentration or higher and then heat is applied so that the temperature becomes no less than glass transition point of resin particles. Thereby, coagulation progresses, while fusion is carried out. At this time, a technique may be utilized wherein an organic solvent that is infinitely soluble in water is added so as to substantially lower the temperature of the glass transition point of the resin particles. Thereby, fusion is effectively carried out.

Metal atoms such as lithium, potassium, and sodium are cited as alkali metal atoms while metal atoms such as magnesium, calcium, strontium, and barium are cited as alkali earth metal atoms of an alkali metal salt or an alkali earth metal salt, which are salting agents. In particular, metal atoms such as potassium, sodium, magnesium, calcium, and barium are preferable. As for the form of salt of an alkali metal salt and an alkali earth metal salt, chloride, bromide, iodide, carbonate, and sulfate are cited.

As for an organic solvent that is infinitely soluble in water, methanol, ethanol, 1-propanol, 2-propanol, ethylene glycol, glycerin, acetone, for example, are cited. Alcohols that have three or fewer carbon atoms, such as methanol, ethanol, 1-propanol or 2-propanol are preferable and 2-propanol is more preferable.

As for the temperature at the time that the salting agent is added, a temperature that is no higher than the temperature of the glass transition point of resin particles is necessary. This is because in the case that the temperature at the time of addition of the salting agent is at or higher than the temperature of the glass transition point, though the salting out/fusion of resin particles progresses at a high rate, it becomes difficult to control particle size and a problem arises wherein particles having a large particle size are generated. As for the range of this temperature when the salting agent is added, though a temperature that is at or below the glass transition temperature of the resin particles is acceptable, it is, in general, between 5° C. and 55° C., preferably between 10° C. and 45° C. A method is preferable wherein the salting agent is added at a temperature that is at or below the glass transition temperature of the resin particles and then the temperature increases as quickly as possible, and heat is applied so that the temperature becomes higher than the glass transition temperature of the resin particles.

It is preferable for the resin particles to be prepared by emulsion polymerization. As for the monomers to be polymerized for preparation of these resin particles, the essential components thereof are monomers that undergo radical polymerization and a crosslinking agent can be utilized if necessary. In addition, the following monomers having an acidic group that undergo radical polymerization or monomers having a basic group that undergo radical polymerization may be included.

The monomers that undergo radical polymerization are not particularly limited. Conventionally known monomers that undergo radical polymerization can be used. For example, aromatic vinyl monomers, (meth) acrylic ester monomers, vinyl ester monomers, vinyl ether monomers, monoolefine monomers, diolefin monomers, halogenated olefin monomers etc. can be used.

Aromatic vinyl monomers are exemplified by styrene monomers such as styrene, o-methyl styrene, m-methyl styrene, p-methyl styrene, p-methoxy styrene, p-phenyl styrene, p-chlorostyrene, p-ethyl styrene, p-n-butyl styrene, p-tert-butyl styrene, p-n-hexyl styrene, p-n-octyl styrene, p-n-nonyl styrene, p-n-decyl styrene, p-n-dodecyl styrene, 2,4-dimethyl styrene, 3,4-dichlorostyrene and derivatives thereof.

(Meth) acrylic ester-based monomers are exemplified by acrylic acid, methacrylic acid, methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxy acrylate, propyl γ-aminoacrylate, stearyl methacrylate, dimethylaminoethyl methacrylate, diethylaminoethyl methacrylate, and the like.

Vinyl ester monomers are exemplified by vinyl acetate, vinyl propionate, vinyl benzoate, and the like. Vinyl ether monomers exemplified by vinyl methyl ether, vinyl ethyl ether, vinyl isobutyl ether, vinyl phenyl ether. Monoolefin-based monomers are exemplified by ethylene, propylene, isobutylene, 1-butene, 1-pentene, 4-methyl-1-pentene. Diolefin monomers are exemplified by butadiene, isoprene, chloroprene. Halogenated olefin monomers are exemplified by vinyl chloride, vinylidene chloride, vinyl bromide.

A crosslinking agent for radical polymerization may be utilized in order to improve the characteristics of the resin particles. Crosslinking agents for radical polymerization are exemplified by a crosslinking agent having two or more unsaturated bonds such as divinyl benzene, divinyl naphthalene, divinyl ether, diethylene glycol methacrylate, ethylene glycol dimethacrylate, polyethylene glycol dimethacrylate, diaryl phthalate. It is preferable to utilize the crosslinking agent for radical polymerization in a range of 0.1 to 10 parts by weight relative to 100 parts by weight of the total monomers that undergo radical polymerization.

As for monomers for radical polymerization having an acidic group, for example, monomers including a carboxyl group or a sulfone group can be used.

Monomers including a carboxyl acid group are exemplified by acrylic acid, methacrylic acid, fumaric acid, maleic acid, itaconic acid, cinnamic acid, monobutyl ester maleate and monooctyl ester maleate. Monomers including sulfonic acid are exemplified by styrene sulfonate, aryl sulfosuccinic acid and octyl aryl sulfosuccinate. These may have structures of alkaline metal salt such as of sodium or potassium or may have structures of alkaline earth metal salt such as of calcium.

As for radical polymerization monomers having a basic group, for example, amine compounds such as primary amine, secondary amine, tertiary amine and quaternary ammonium salt can be used.

Amine compounds are exemplified by dimethylaminoethyl acrylate, dimethylaminoethyl methacrylate, diethylaminoethyl acrylate, diethylaminoethyl methacrylate, quaternary ammonium salts of the above described four compounds, 3-dimethylaminophenyl acrylate, 2-hydroxy-3-methacryl oxypropyl trimethyl ammonium salt, acrylamide, N-butyl acrylamide, N,N-dibutyl acrylamide, piperidyl acrylamide, methacrylamide, N-butyl methacrylamide, N-octadecyl acrylamide, vinyl pyridine, vinyl pyrrolidone, vinyl N-methyl pyridinium chloride, vinyl N-ethyl pyridinium chloride, N,N-diaryl methyl ammonium chloride and N,N-diaryl ethyl ammonium chloride.

A radical polymerization initiator used in emulsion polymerization can be utilized properly as long as it is water soluble. For example, persulfates such as potassium persulfate and ammonium persulfate, azo compounds such as 4,4'-azobis 4-cyano valerate, the salt thereof and 2,2'-azobis (2-amidinopropane) salt, and peroxide compound etc. are cited. It is possible to use the above described radical polymerization initiator in the form of a redox initiator by combining it with a reducing agent if necessary. When a redox initiator is utilized, polymerization activation is increased, lowering of the polymerization temperature can be achieved, and shortening of polymerization time period can be expected.

As for the polymerization temperature, any temperature may be selected as long as it is the minimum radical generation temperature or higher of the polymerization initiator and the range between 50° C. and 90° C. is preferable. It is possible to carry out polymerization at room temperature or higher in combination of a polymerization initiators for initiation at room temperature, such as hydrogen peroxide-a reducing agent (such as ascorbic acid).

It is preferable to utilize a surfactant for emulsion polymerization of the above described monomers that undergo radical polymerization. The surfactant that can be utilized is not particularly limited and the following anionic or nonionic surfactants can be cited as preferable examples.

Anionic surfactants are exemplified by sodium dodecyl benzene sulfonate, sodium aryl alkyl polyether sulfonate, and the like, which are sulfonic acid salts, and sodium dodecyl sulfate, sodium tetradecyl sulfate, sodiumpentadecyl sulfate, sodium octyl sulfate, and the like, which are sulfate salts, as well as sodium oleate, sodium laurate, sodium caprate, sodium caprylate, sodiumcaproate, potassiumstearate, calsiumoleate, which are fatty acid salts.

Nonionic surfactants are exemplified by polyethylene oxide, polypropylene oxide, a combination of polyethylene oxide and polypropylene oxide, alkyl phenol polyethylene oxide, an ester of a higher fatty acid and polyethylene glycol, an ester of a higher fatty acid and polypropylene oxide, sorbitan ester, and the like.

It is preferable to use an inorganic pigment or an organic pigment as a coloring agent. As for an inorganic pigment, a conventionally known black pigment or magnetic pigment can be cited. As for a black pigment, for example, carbon blacks, such as furnace black, channel black, acetylene black, thermal black, lamp black, and magnetic pigment such as magnetite and ferrite can be used. It is possible to use these inorganic pigments alone or in a combination as desired. It is preferable that addition amount of inorganic pigment is 2 to 20 parts by weight, preferably 3 to 15 parts by weight relative to the 100 parts by weight of toner particles. When the toner of the present invention is used as a magnetic toner, the above described magnetic pigment can be added. In the case of a magnetic toner, it is preferable to add a magnetic pigment of 20 to 60 parts by weight relative to the 100 parts by weight of toner particles from the point of view of addition of magnetic characteristics.

As for the organic pigment, conventional organic pigments can be used. Though any type of organic pigment can be utilized, organic pigments are concretely exemplified by the following.

Magenta or red pigments are exemplified by C. I. pigment red 2, C. I. pigment red 3, C. I. pigment red 5, C. I. pigment red 6, C. I. pigment red 7, C. I. pigment red 15, C. I. pigment red 16, C. I. pigment red 48:1, C. I. pigment red 53:1, C. I. pigment red 57:1, C. I. pigment red 122, C. I. pigment red 123, C. I. pigment red 139, C. I. pigment red 144, C. I. pigment red 149, C. I. pigment red 166, C. I. pigment red 177, C. I. pigment red 178, C. I. pigment red 222.

Orange or yellow pigments are exemplified by C. I. pigment orange 31, C. I. pigment orange 43, C. I. pigment yellow 12, C. I. pigment yellow 13, C. I. pigment yellow 14, C. I. pigment yellow 15, C. I. pigment yellow 17, C. I. pigment yellow 74, C. I. pigment yellow 93, C. I. pigment yellow 94, C. I. pigment yellow 138, C. I. pigment yellow 180.

Cyan or green pigments are exemplified by C. I. pigment blue 15, C. I. pigment blue 15:2, C. I. pigment blue 15:3, C. I. pigment blue 16, C. I. pigment blue 60, C. I. pigment green 7.

It is possible to use these organic pigments alone or in combination as desired. It is preferable that addition amount of the pigment is 2 to 20, preferably 3 to 15 parts by weight relative to the 100 parts of toner particles.

A surface modifying agent for a coloring agent can be utilized in order to modify the quality of the surface of the coloring agent. As for the surface modifying agent for a coloring agent, conventionally known agents can be utilized. Concretely, a silane coupling agent, a titanium coupling agent, an aluminum coupling agent etc. can be preferably used.

As for the wax, for example, polyethylene wax, polyethylene wax that has been subjected to an oxidation-modified process (oxidized-type polyethylene wax), polypropylene wax, polypropylene wax that has been subjected to an oxidation-modified process (oxidized-type polypropylene wax), paraffin wax, microcrystalline wax, carnauba wax, ester wax etc. are cited.

The ester wax is preferably exemplified by the one represented by the following general formula:

$$R_1—(OCO—R_2)n$$

in which $R_1$ and $R_2$ represent a hydrocarbon group which may have a substituent; n is an integer of 1–4, preferably 2–4, more preferably 3–4, particularly preferably 4; the carbon number of $R_1$ is 1–40, preferably 1–20, more preferably 2–5; the carbon number of $R_2$ is 1–40, preferably 16–30, more preferably 18–26.

Wax can be added by means of a variety of manners, such as a manner for adding the wax at the stage when the resin particles are emulsified and polymerized, a manner for simultaneously adding the wax and the resin particles in the coagulation (salting out) process, and a method for directly adding the wax to a prepared toner particles. As for preferable methods, a method for adding the wax at the stage of emulsion polymerization of the above described resin particles, and a method for simultaneously adding the wax and the resin particles in the above described coagulation (salting out) process so that the wax is included in the toner, can be cited.

Additives that can add a variety of functions may be added as toner components in addition to the above described coloring agent and wax. Concretely, a charge control agent etc. is cited.

These additives can be added by means of a variety of manners, such as a manner for adding the additive at the stage when the resin particles are emulsified and polymerized, a manner for simultaneously adding the additive and the resin particles in the coagulation (salting out) process, and a manner for directly adding the additive to a prepared toner. As for preferable methods, a method for adding the additive at the stage of emulsion polymerization of the above described resin particles, and a method for simultaneously adding the additive and the resin particles in the above described coagulation (salting out) process so that the additive is included in the toner, can be cited.

As for the charge control agent utilized as an additive, it is preferable to utilize a conventionally known substance that can be dispersed in water. Concretely, naphthenic acid or a metal salt of a higher fatty acid, an azo-based metal complex, a metal salicylate, or metal complexes thereof are cited. It is preferable that the charge control agent has a mean primary particle size of approximately 10 nm to 500 nm in the dispersed condition.

In the present invention, a toner without a charge control agent is preferable from the point of view of environmental protection as well as from the point of view of reduction of cost of the toner.

Toner particles in an aqueous medium gained in the fusion process are filtered and washed in cleansing water so that impurities attached to the toner particles, such as surfactants or salting agents, are removed. The filter and the cleaning machine utilized in this process are not particularly limited, while a centrifugal separator, a Nutsche filter, a filter press etc., for example, may be used.

The toner particles after filtration and washing are dried. The drier utilized in this process is not particularly limited, while a spray drier, a reduced pressure drier, a vacuum drier, a stationary shelf drier, a mobile shelf drier, a floating layer-type drier, a rotating drier, a stir-type drier, or the like, is used. It is preferable that an amount of water in 100 parts by weight of the toner particles after drying is 5 parts by weight or less, preferably 2 parts by weight or less.

As above mentioned, the external additive of 2.1–5.5 parts by weight, preferably 2.3–5.5 parts by weight, more preferably 2.5–5.3 parts by weight is added to 100 parts by weight of the toner particles obtained in the wet granulation method so that BET specific surface area of the toner may be in a range of 2.0 to 4.0 $m^2/g$, preferably 2.1–3.9 $m^2/g$, more preferably 2.2–3.7 $m^2/g$ after the external additives are added externally to the toner particles.

When a specific amount of the external additive is added externally to the toner particles so that BET specific surface area of the toner may be in a specific range after external addition, it become possible to reduce a difference in the quantity of electro static charge due to color difference (difference in colorants) in full-color toner particles obtained through the wet-type granulation method. When wax is contained at a large content in toner particles for oilless fixing, the problem on deterioration of heat-resistant storage property can be improved without adverse effects to cleaning properties. Fogging problem can be solved when used as a non-magnetic monocomponent developer.

In order to adjust the BET specific surface area of the toner in a range of 2.0 to 4.0 $m^2/g$, by adding a great amount of external additive, such as 2.1 to 5.5 parts by weight with respect to 100 parts by weight of toner particles, it is necessary to increase the adhesive strength of the external additive to the toner particles so as to reduce the external additive that is isolated from the toner particles.

With respect to the externally-applying and mixing processes of the external additive to the toner particles, a mixing device such as a Henschel mixer that can apply a shearing force to the particles to be processed is preferably used with a prolonged mixing time and/or an increased rotation peripheral speed of stirring blades. Moreover, in the case when a plurality of kinds of external additives are used, a batch mixing process may be carried out on the toner particles, or divided mixing processes may be carried out in a separated manner depending on the respective external additives.

With respect to the external additives, well-known inorganic fine particles and organic fine particles may be used, with the amount of addition to the toner particles and the toner BET specific surface area after the addition of the external additive being set in the above-mentioned ranges.

In order to get such an external additive, at least first inorganic fine particles that have been surface-treated by a hydrophobizing agent to have a BET specific surface area of 150 to 300 $m^2/g$ after surface treatment, second inorganic fine particles that have been surface-treated by a hydrophobizing agent to have a BET specific surface area of 30 to 100 $m^2/g$ after surface treatment and third inorganic fine particles having a BET specific surface area of 3 to 20 $m^2/g$ are used. Moreover, the external additives may be adjusted so that the total specific surface area H of the external additive is set to 200 to 530 $m^2/g$ with respect to 100 parts by weight of the toner particles.

In the present specification, the specific surface area of the external additive per 100 parts by weight of toner particles is found by multiplying the amount of addition (parts by weight) per 100 parts by weight of the toner particles by the BET specific surface area ($m^2/g$) of the external additive.

In the case when at least three kinds of specific external additives are externally added to the toner particles so as to have the above-mentioned specific total specific surface area as described above, it is possible to reduce a difference in the quantity of electro static charge due to color difference (difference in colorants) in full-color toner particles obtained through the wet-type granulation method. Moreover, even when a great amount of wax is contained in the toner particles so as to provide an oil-less fixing process, it is possible to prevent degradation in the heat-resistant storage property. It is also possible to improve the transferring property at the time of full-color image formation, and consequently to prevent an image loss. It is also possible to improve the cleaning property while preventing abrasion in the photosensitive member and the cleaning blade.

The BET specific surface area of the first hydrophobic silica is set to 150 to 300 $m^2/g$, preferably 160 to 280 $m^2/g$, more preferably 170 to 260 $m^2/g$. The first inorganic fine particles are preferably used so that the specific surface area H1 of the first inorganic fine particles added to 100 parts by weight of toner particles is set to 170 to 430 $m^2/g$, preferably 180 to 420 $m^2/g$, most preferably 200 to 400 $m^2/g$. Hydrophobic silica is preferably used as the first inorganic fine particles. The application of the first inorganic fine particles makes it possible to improve the fluidity of the toner and the texture of images etc.

The first inorganic fine particles are externally added to the toner particles so that it becomes possible to solve the problem with a difference in quantities of electro static charge due to a difference in colorants in full-color toner particles that have been adjusted through the wet-type granulation method and the problem with heat-resistance storing property. It becomes possible to provide desired fluidity and desired negative chargeability to the toner.

The average primary particle size of the first inorganic fine particles is set to 5 to 18 nm, preferably 5 to 16 nm, more preferably 6 to 15 nm.

The BET specific surface area of the second inorganic fine particles is set to 30 to 100 $m^2/g$, preferably 40 to 90 $m^2/g$, more preferably 50 to 80 $m^2/g$. The second inorganic fine particles are preferably used so that the specific surface area H2 of the second inorganic fine particles added to 100 parts by weight of toner particles is set to 20 to 110 $m^2/g$, preferably 25 to 100 $m^2/g$, more preferably 30 to 90 $m^2/g$. Hydrophobic silica is preferably used as the second inorganic fine particles. The application of the second inorganic fine particles makes it possible to solve a problem of defective images (image loss) upon carrying out a transferring process by using a transferring roller.

By externally adding the second inorganic fine particles to the toner particles in this manner, it becomes possible to improve the transferring property of the toner, and, for example, even when a press-transferring process is carried out by using a transferring roller, it becomes possible to solve the problem of image loss. It is possible to maintain the negative chargeability of the toner.

The average primary particle size of the second inorganic fine particles is set to 18 to 50 nm, preferably 20 to 40 nm, more preferably 20 to 35 nm.

As described above, hydrophobic silica is preferably used as the first inorganic fine particles and the second inorganic fine particles, and, for example, when these are changed to hydrophobic titanium oxide or the like, a problem such as reduction in the quantity of electro static charge arises.

The BET specific surface area of the third inorganic fine particles is set to 3 to 20 $m^2/g$, preferably 3 to 15 $m^2/g$, more preferably, 5 to 15 $m^2/g$. The third inorganic fine particles are preferably used so that the specific surface area H3 of the third inorganic fine particles added to 100 parts by weight of toner particles is set to 8 to 30 $m^2/g$, preferably 8 to 22 $m^2/g$, more preferably 12 to 20 $m^2/g$. Strontium titanate is preferably used as the third inorganic fine particles. The application of the third inorganic fine particles makes it possible to reduce filming and image noise (BS) without damaging the photosensitive member and the cleaning blade.

By externally adding the third inorganic fine particles, a static layer made from the third inorganic fine particles is formed in a gap between the photosensitive member and the cleaning blade so that it becomes possible to prevent the other external additives from passing through the gap, to reduce BS on a copied image due to adhering of the external additive onto the surface of the photosensitive member, and also to provide an appropriate polishing process to the photosensitive member. The third inorganic fine particles have slightly positive chargeability; therefore, it is considered that, when these are externally added to a negatively chargeable non-magnetic single-component toner, a function for applying negative chargeability to the toner is exerted, and it becomes possible to improve the charging property of the negatively chargeable toner.

The average primary particle size of the third inorganic fine particles is set to 100 to 800 nm, preferably 150 to 700 nm, more preferably 200 to 600 nm.

Besides the above-mentioned three kinds of external additives, the fourth inorganic fine particles or well known inorganic fine particles and organic fine particles may be added as external additives. In this case also, the total specific surface area S of the external additives per 100 parts by weight of the toner particles needs to be set to 200 to 530 $m^2/g$.

As such the above-mentioned external additive, hydrophobic titanium oxide is preferably used. The BET specific surface area of the hydrophobic titanium oxide is set to 30 to 250 $m^2/g$, preferably 40 to 180 $m^2/g$, more preferably 50 to 150 $m^2/g$.

By externally adding such hydrophobic titanium oxide to the toner particles together with the above-mentioned specific three kinds of external additives, it becomes possible to finely adjust the quantity of electro static charge of the toner and also to improve the environmental stability of the toner.

The hydrophobic titanium oxide is preferably used so that the specific surface area H4 thereof per 100 parts by weight of toner particles is set to 5 to 100 $m^2/g$, preferably 10 to 90 $m^2/g$, more preferably 20 to 80 $m^2/g$.

The average primary particle size of titanium oxide to be used for the hydrophobic titanium oxide is preferably set to 10 to 80 nm, preferably 15 to 60 nm, more preferably 20 to 50 nm.

The toner of the present invention is applicable to both of the mono-component developing agent to be used without carrier and the two-component developing agent to be used together with carrier; however, in particular, it is preferably used as a negatively chargeable developer for use in the non-magnetic single-component developing system. In the case when the toner of the present invention is used as black toner, it is used as any of magnetic and non-magnetic toners; however, it is preferably used as a non-magnetic full color toner. In the case of the black toner for use as a full color toner, it is used as any of magnetic and non-magnetic toners.

With respect to a carrier used as the two-component developing agent, any known carrier may be used, and, for example, any of carriers, such as a carrier made of magnetic particles like iron powder and ferrite, coat-type carriers having the magnetic particle surface coated with a coating agent such as resin, and binder-type carriers formed by dispersing magnetic particles in a binder resin, may be used. The volume-average particle size of these carriers is preferably set to 20 to 60 $\mu$m, preferably 25 to 50 $\mu$m.

The toner of the present invention is preferably designed to have a volume-average particle size of 3 to 7 $\mu$m, preferably 4 to 7 $\mu$m, more preferably 4 to 6 $\mu$m.

In the case when the toner of the present invention is used as a full-color toner, a preferable full-color image-forming apparatus has an arrangement in which a toner image is formed on an electrostatic latent image supporting member, a process for transferring this toner image from the electrostatic latent image supporting member to an intermediate transferring member is carried out for each of predetermined colors successively to form a full-color toner image by superposing the toner images of the respective colors on the intermediate transferring member, and after the full-color toner image on the intermediate transferring member has been transferred onto a recording medium (for example, recording paper) from the intermediate transferring member by using a secondary transferring roller at a portion in which the intermediate transferring member (for example, an intermediate transferring belt) is supported by a supporting roller, the full-color toner image on the recording medium is fixed to form a full-color image.

In the full-color image-forming apparatus as described above, when the toner image is subjected to an oil-less fixing process, a fixing method including a process in which the recording medium with the toner image thereon is allowed to pass through a press-contact portion between a heating member and a pressure member or a pressure heat-applying member that is made in press-contact with the heating member is preferably adopted; in particular, in an attempt to effectively separate paper from the heating member, it is preferable to allow the nip structure of the press-contact portion to have a convex shape. In an attempt to further improve the separation between paper and the heating member, the surface of the heating member is preferably formed by a fluorine-containing resin, such as PFA (ethylene tetrafluoride-perfluoroalkylvinyl ether copolymer), ethylene polytetrafluoride and polyvinylidene fluoride.

With respect to the fixing device using such a fixing method, for example, a fixing device schematically shown in FIG. 1 is preferably used. The fixing device shown in FIG. 1 is provided with a heating roller 11 serving as a heating member and a pressure roller 12 serving as a pressure member. More specifically, the fixing device has the heating roller 11, a pressure roller 12 that is made in press-contact with the heating roller, a separation claw 13 used for separating a sheet after having been fixed from the heating roller, a cleaning web 14 for cleaning the surface of the heating roller, a web roller 15 around which the cleaning web is wound, and a winding roller 16 for winding the cleaning web up. The heating roller 11 is normally constituted by an elastic material layer 18 and a surface layer 19 placed on an aluminum core metal 17, with a heater 20 being installed in the aluminum core metal. The pressure roller 12 is normally constituted by an elastic material layer 22 and a surface layer 23 placed on an aluminum core metal 21. Here, the pressure roller 12 may also be provided with a heater inside the aluminum core metal 21. Although not particularly limited, the material of the elastic material layer (18, 22) is preferably made of silicon rubber, preferably, foamed silicon rubber. When the foamed silicon rubber is used, it is possible to achieve a sufficiently wide press-contact portion width (nip width), with the press-contact force of the pressure roller to the heating roller being maintained at a low level. Although not particularly limited, the material of the surface layer (19, 23) is preferably made of a fluorine-containing resin, in particular, PFA (tetrafluoroethylene-perfluoroalkyl vinyl ether copolymer).

In FIG. 1, a nip 24 having a convex shape is formed on the heating roller side (on the upper side in FIG. 1) of the press-contact portion of the heating roller 11 and the pressure roller 12. The shape of the nip 24 maybe a flat shape; however, a convex shape protruding toward the heating roller side is preferably used in order to improve the separating property of paper from the heating roller 11. A recording medium (recording paper 25) with a toner image 26 is allowed to pass from right to left in the Figure so that a fixing process is carried out. The cleaning web 14, the web roller 15 and the winding roller 16 may be omitted on demand.

Referring to Examples, the following description will explain the present invention more specifically.

EXAMPLES (Manufacturing Process of Resin Particles)

To a 5,000 ml separable flask provided with a stirring device, a temperature sensor, a cooling tube and a nitrogen introducing device was added a solution prepared by preliminarily dissolving 7.08 g of an anionic active agent (sodium dodecyl benzene sulfonate: SDS) in ion exchange water (2,760 g). While this was being stirred at a stirring rate of 230 rpm in a nitrogen gas flow, the inner temperature was raised to 80° C. To a monomer made from 115.1 g of styrene, 42.0 g of n-butyl acrylate and 10.9 g of methacrylic acid was added 72.0 g of the following compound: $CH_3(CH_2)_{20}$ $COOCH_2C(CH_2OCO(CH_2)_{20}CH_3)_3$, and heated to 80° C. to be dissolved; thus, a monomer solution was prepared.

The above-mentioned heated solution was mixed and dispersed by using a mechanical dispersing machine having a circulating path so that emulsified particles having a uniform dispersed particle size was formed. Successively, to this was added a solution prepared by dissolving 0.90 g of a polymerization initiator (potassium persulfate: KPS) in 200 g of ion exchange water, and this was heated and stirred at 80° C. for 3 hours to give latex particles. To this was further added a solution prepared by dissolving 8.00 g of the polymerization initiator (KPS) in 240 ml of ion exchange water, and 15 minutes later, to this was added at 80° C. through dripping a mixed solution of 383.6 g of styrene, 140.0 g of n-butyl acrylate, 36.4 g of methacrylic acid and 13.7 g of t-dodecyl mercaptan in 120 minutes. After this was heated and stirred for 60 minutes after the completion of the dripping process, this was cooled to 40° C. to give resin particles-containing ester wax.

(Preparation of Toner Particles)

To 160 ml of ion exchange water was added 10 g of n-dodecyl sodium sulfate, and stirred and dissolved. To this solution was gradually added 20 g of C. I. Pigment Blue 15–3 (cyan pigment) while being stirred, and dispersed by using CLEARMIX. This dispersion solution was used as a cyan colorant dispersion solution.

To a 5-liters four-necked flask provided with a temperature sensor, a cooling tube, a nitrogen introducing device and a stirring device was added 1250 g of the above-mentioned resin particles, 2000 ml of ion exchange water and the colorant dispersion solution, and stirred. After this was adjusted to 30° C., to this was added 5 moles/liter of an aqueous solution of sodium hydroxide to adjust pH to 10.0. Then, to this was added an aqueous solution prepared by dissolving 52.6 g of magnesium chloride hexahydrate in 72 ml of ion exchange water at 30° C. for 5 minutes while being stirred. Thereafter, after this had been left for 1 minute, this was heated to a solution temperature of 90° C. in 6 minutes (temperature-rising rate=10° C./minute).

In this state, the particle size was measured by COULTER COUNTER TA-II, and at the time when the volume average particle size reached 6.5 μm, to this was added an aqueous solution prepared by dissolving 115 g of sodium chloride in 700 ml of ion exchange water so that the growth of the particles was stopped, and this was continuously heated and stirred for 6 hours at a solution temperature of 90° C.±2° C. to be subjected to salting out and fusion. Thereafter, the resultant was cooled to 30° C. under a condition of 6° C./min, and to this was added hydrochloric acid to adjust the pH to 2.0, and the stirring process was stopped. The colored particles thus produced were filtered, and repeatedly washed with ion exchange water, and then dried by hot air at 40° C. so that cyan toner particles 1 (C1) having a volume-average particle size of 6.4 μm were obtained.

The same processes as the cyan colorant dispersion solution were carried out except that C. I. Pigment Blue 15–3 was replaced by carbon black (REGAL 330R: made by Cabot Corporation) to prepare a black colorant dispersion solution. Then, the same processes as cyan toner particles 1 were carried out except that the cyan colorant dispersion solution was replaced by the black colorant dispersion solution to prepare black toner particles 1 (Bk1).

The same processes as cyan toner particles 1 were carried out except that the growth of the particles were stopped at the time when the volume-average particle size reached 4.5 μm so that cyan toner particles 2 (C2) having a volume-average particle size of 4.4 μm were obtained.

The same processes as cyan toner particles 2 were carried out except that the cyan colorant dispersion solution was replaced by the black colorant dispersion solution to prepare black toner particles 2 (Bk2).

To 100 parts by weight of each kind of the toner particles was added each of external additive agents shown in Table 1 with each amount of addition shown in Table 1, and mixed by using Henschel mixer to obtain a toner.

TABLE 1

| | | External additive | | | | | | | | | | | | |
|---|---|---|---|---|---|---|---|---|---|---|---|---|---|---|
| | | First external additive | | | Second external additive | | | Third external additive | | | Four external additive | | | |
| | Toner particle | Kind | amount of addition (pbw) | H1 ($m^2/g$) | Kind | amount of addition (pbw) | H2 ($m^2/g$) | Kind | amount of addition (pbw) | H3 ($m^2/g$) | Kind | amount of addition (pbw) | H4 ($m^2/g$) | Total specific surface area ($m^2/g$) |
| Ex. 1 | C1, Bk1 | S1 | 1,1 | 248 | S5 | 0.7 | 49 | TSr1 | 2.0 | 16 | — | — | — | 313 |
| Ex. 2 | C2, Bk2 | S2 | 1.6 | 416 | S5 | 1.2 | 84 | TSr1 | 2.5 | 20 | — | — | — | 520 |
| Ex. 3 | C1, Bk1 | S3 | 1.5 | 255 | S5 | 0.7 | 49 | TSr1 | 2.0 | 16 | — | — | — | 320 |
| Ex. 4 | C1, Bk1 | S1 | 1.1 | 248 | S6 | 1.1 | 44 | TSr1 | 2.0 | 16 | — | — | — | 308 |
| Ex. 5 | C1, Bk1 | S1 | 1.1 | 248 | S5 | 0.7 | 49 | TSr2 | 2.0 | 18 | — | — | — | 315 |
| Ex. 6 | C1, Bk1 | S1 | 0.8 | 180 | S5 | 0.4 | 28 | TSr1 | 1.5 | 12 | — | — | — | 220 |
| Ex. 7 | C1, Bk1 | S1 | 1.1 | 248 | S5 | 0.7 | 49 | TSr1 | 2.0 | 16 | T1 | 0.6 | 60 | 373 |
| Com. Ex. 1 | C1, Bk1 | S1 | 1.5 | 338 | — | — | — | TSr1 | 2.0 | 16 | — | — | — | 354 |
| Com. Ex. 2 | C1, Bk1 | — | — | — | S5 | 3.0 | 210 | TSr1 | 2.0 | 16 | — | — | — | 226 |
| Com. Ex. 3 | C1, Bkl | S1 | 1.1 | 248 | T2 | 1.0 | 60 | TSr1 | 2.0 | 16 | — | — | — | 324 |
| Com. Ex. 4 | C1, Bk1 | T1 | 2.0 | 200 | S5 | 0.7 | 49 | TSr1 | 2.0 | 16 | — | — | — | 265 |
| Com. Ex. 5 | C1, Bk1 | T1 | 3.0 | 300 | — | — | — | TSr1 | 2.0 | 16 | — | — | — | 316 |
| Com. Ex. 6 | Cl, Bk1 | S4 | 2.0 | 220 | S5 | 0.7 | 49 | TSr1 | 2.0 | 16 | — | — | — | 285 |
| Com. Ex. 7 | C1, Bk1 | S1 | 0.9 | 203 | S3 | 0.6 | 102 | TSr1 | 2.0 | 16 | — | — | — | 321 |

TABLE 1-continued

| | | External additive | | | | | | | | | | | | |
|---|---|---|---|---|---|---|---|---|---|---|---|---|---|---|
| | | First external additive | | | Second external additive | | | Third external additive | | | Four external additive | | | |
| | Toner particle | Kind | amount of addition (pbw) | H1 ($m^2/g$) | Kind | amount of addition (pbw) | H2 ($m^2/g$) | Kind | amount of addition (pbw) | H3 ($m^2/g$) | Kind | amount of addition (pbw) | H4 ($m^2/g$) | Total specific surface area ($m^2/g$) |
| Com. Ex. 8 | C1, Bk1 | S5 | 2.5 | 175 | S6 | 2.0 | 80 | TSr1 | 2.0 | 16 | — | — | — | 271 |
| Com. Ex. 9 | C1, Bk1 | S1 | 1.1 | 248 | S5 | 0.7 | 49 | TSr3 | 2.0 | 82 | — | — | — | 379 |
| Com. Ex. 10 | C1, Bk1 | S1 | 1.1 | 248 | S5 | 0.7 | 49 | TSr4 | 2.0 | 4 | — | — | — | 301 |
| Com. Ex. 11 | C1, Bk1 | S1 | 0.6 | 135 | S5 | 0.4 | 28 | TSr1 | 2.0 | 16 | — | — | — | 179 |
| Com. Ex. 12 | C1, Bk1 | S1 | 1.8 | 468 | S5 | 1.0 | 70 | TSr1 | 2.0 | 16 | — | — | — | 554 |
| Com. Ex. 13 | C1, Bk1 | S1 | 1.1 | 248 | S5 | 0.7 | 49 | — | — | — | — | — | — | 297 |
| Com. Ex. 14 | C1, Bk1 | S1 | 1.3 | 293 | S5 | 0.7 | 49 | TSr1 | 2.0 | 16 | T1 | 2.0 | 200 | 558 |

In Table 1, S1 represents hydrophobic silica (TS500: made by Cabot Corporation) having an average primary particle size of 7 nm, and a BET specific surface area of 225 $m^2/g$. S2 represents hydrophobic silica (BET specific surface area 260 $m^2/g$) that is obtained by surface-treating silica (300: made by Nippon Aerosil K.K.) having an average primary particle size of 7 nm by using hexamethyl disilazane (HMDS) that is a hydrophobizing agent. S3 represents hydrophobic silica (R974: made by Nippon Aerosil K. K.) having an average primary particle size of 12 nm and a BET specific surface area of 170 $m^2/g$. S4 represents hydrophobic silica (R972: made by Nippon Aerosil K. K.) having an average primary particle size of 16 nm and a BET specific surface area of 110 $m^2/g$. S5represents hydrophobic silica (BET specific surface area 70 $m^2/g$) that is obtained by surface-treating silica (90G: made by Nippon Aerosil K. K.) having an average primary particle size of 20 nm by using hexamethyl disilazane (HMDS) that is a hydrophobic-property applying agent. S6 represents hydrophobic silica (BET specific surface area 40 $m^2/g$) that is obtained by surface-treating silica (OX50: made by Nippon Aerosil K. K.) having an average primary particle size of 40 nm by using hexamethyl disilazane (HMDS) that is a hydrophobizing agent. T1 represents hydrophobic titanium oxide (BET specific surface area 100 $m^2/g$) that is obtained by surface-treating anatase-type titanium oxide having an average primary particle size of 20 nm in a water-based wet system by using isobutyltrimethoxy silane that is a hydrophobizing agent. T2 represents hydrophobic titanium oxide (BET specific surface area 60 $m^2/g$) that is obtained by surface-treating anatase-type titanium oxide having an average primary particle size of 50 nm in a water-based wet system by using isobutyltrimethoxy silane that is a hydrophobizing agent. TSr1 represents strontium titanate having an average primary particle size of 350 nm and a BET specific surface area of 8 $m^2/g$. TSr2 represents strontium titanate having an average primary particle size of 600 nm and a BET specific surface area of 9 $m^2/g$. TSr3 represents strontium titanate having an average primary particle size of 50 nm and a BET specific surface area of 41 $m^2/g$. TSr4 represents strontium titanate having an average primary particle size of 1000 nm and a BET specific surface area of 2 $m^2/g$.

In Table 1, the amount of addition (pbw) represents an amount of addition of each external additive agent with respect to 100 parts by weight of toner particles. H1 represents a specific surface area of a first external additive agent per 100 parts by weight of toner particles, H2 represents a specific surface area of a second external additive agent per 100 parts by weight of toner particles, H3 represents a specific surface area of a third external additive agent per 100 parts by weight of toner particles and H4 represents a specific surface area of a fourth external additive agent per 100 parts by weight of toner particles, respectively. The total specific surface area represents a specific surface area of all the external additive agents per 100 parts by weight of toner particles.

(Evaluation of Quantity of Electro Static Charge)

Cyan toner, prepared by applying each of external additive agents of the respective Examples and Comparative Examples to the cyan toner particles (C1, C2), was loaded into a developing device of a full-color printer LP-3000C (made by Epson K. K.), and after 10 copies of a print pattern having a B/W ratio of 6% had been made under N/N environmental conditions (23° C., 45%), a copy of a white sheet pattern was made, and at this time, cyan toner on a developing roller was sucked so that the quantity of electro static charge of the toner thus sucked was measured by an electrometer, and the weight of the toner was measured; thus, the quantity of electro static charge was given. The toner having the absolute value of a quantity of electro static charge in a range of not less than 25 $\mu$C/g to less than 35 $\mu$C/g was evaluated as O, the toner having the absolute value of a quantity of electro static charge in a range of not less than 20 $\mu$C/g to less than 25 $\mu$C/g or in a range of not less than 35 $\mu$C/g to less than 40 $\mu$C/g was evaluated as Δ, and the toner having the absolute value of less than 20 $\mu$C/g or not less than 40 $\mu$C/g was evaluated as x. The results are shown in Table 2.

(Color Difference Evaluation Relating to Quantity of Electro Static Charge)

In the same manner as the evaluation of quantity of electro static charge, the quantities of electrostatic charge of black toners obtained by applying external additive agents of the respective Examples and Comparative Examples to black toner particles (Bk1, Bk2) were measured. When the absolute value of a difference between quantities of electro static charge of the cyan toner and the black toner was less than 5 $\mu$C/g, this case was evaluated as O; when it was in a range of not less than 5 $\mu$C/g to less than 10 $\mu$C/g, this case was evaluated as Δ; and when it was not less than 10 $\mu$C/g, this case was evaluated as x. The results are shown in Table 2.

(Evaluation of Heat Resistant Storing Property)

Cyan toner (20 g), obtained by applying external additive agents of the respective Examples and Comparative Examples to cyan toner particles (C1, C2), was put into a glass bottle, and after this had been left at a high temperature of 55° C. for 24 hours, the toner was visually observed, and evaluated. When no aggregated toner particles were observed, or when, although softly aggregated toner particles were slightly observed, the aggregated toner particles were easily separated upon application of a slight force, without causing any problem in practical use, this case was evaluated as O; and when aggregated toner particles were observed, with the aggregated particles being not easily separated, to cause problems in practical use, this case was evaluated as x. The results are shown in Table 2.

(Evaluation of Transferring Property)

Each toner, obtained by applying external additive agents of the respective Examples and Comparative Examples to cyan toner particles (C1, C2), was loaded into a developing device of a modified machine of a full-color printer LP-3000C (made by Epson K. K.) (whose fixing device is modified to an oil-less fixing device shown in FIG. 1), and character images were outputted.

The setting conditions of the fixing device shown in FIG. 1 are explained as follows: The heating roller 11, which had an outer diameter of 40 mm, was provided with an elastic material layer 18 made from foamed silicone rubber having a thickness of 1.5 mm, and a surface layer 19 made from PFA. The pressure roller 12, which had an outer diameter of 35 mm, was provided with an elastic material layer 22 made from foamed silicone rubber having a thickness of 3 mm, and a surface layer 23 made from PFA. A nip (nip width 7 mm), which had a convex shape protruding toward the heating roller side, was formed at a contact portion between the heating roller 11 and the pressure roller 12, and a fixing process was carried out at a temperature of 180° C.

The images thus obtained were evaluated, and those images having no image loss, or those having no problems in practical use although slight image loss occurred therein, were evaluated as O; and those images having image loss with problems in practical use were evaluated as x. Table 2 shows the test results.

(Evaluation of Cleaning Property)

In the same manner as the above-mentioned evaluation of the transferring property, 5,000 sheets of character images were continuously printed, and with respect to these images, image noises (residual toner, BS, filming) due to defective cleaning processes were confirmed. Those images having no image noise resulting from cleaning processes, or those images having no problems in practical use although slight noise occurred therein, were evaluated as O; and those images having image noise resulting from cleaning processes with problems in practical use as images were evaluated as x. Table 2 shows the test results.

TABLE 2

| | Color difference evaluation relating to quantity of electrostatic charge | Quantity of electrostatic charge | Heat resistant storing property | Transferring property | Cleaning property |
|---|---|---|---|---|---|
| Ex. 1 | ○ | ○ | ○ | ○ | ○ |
| Ex. 2 | ○ | ○ | ○ | ○ | ○ |
| Ex. 3 | ○ | ○ | ○ | ○ | ○ |
| Ex. 4 | ○ | ○ | ○ | ○ | ○ |
| Ex. 5 | ○ | ○ | ○ | ○ | ○ |
| Ex. 6 | ○ | ○ | ○ | ○ | ○ |
| Ex. 7 | ○ | ○ | ○ | ○ | ○ |
| Com. Ex. 1 | ○ | ○ | ○ | x | ○ |
| Com. Ex. 2 | ○ | ○ | x | ○ | x |
| Com. Ex. 3 | ○ | ○ | ○ | x | ○ |
| Com. Ex. 4 | ○ | Δ | ○ | ○ | x |
| Com. Ex. 5 | ○ | x | ○ | x | x |
| Com. Ex. 6 | ○ | ○ | ○ | ○ | x |
| Com. Ex. 7 | ○ | ○ | ○ | x | ○ |
| Com. Ex. 8 | ○ | ○ | ○ | ○ | x |
| Com. Ex. 9 | ○ | ○ | ○ | ○ | x |
| Com. Ex. 10 | ○ | ○ | ○ | ○ | x |
| Com. Ex. 11 | x | ○ | x | ○ | ○ |
| Com. Ex. 12 | ○ | ○ | ○ | ○ | x |
| Com. Ex. 13 | ○ | ○ | ○ | ○ | x |
| Com. Ex. 14 | ○ | Δ | ○ | ○ | x |

To 100 parts by weight of each kind of the toner particles was added each of external additive agents shown in Table 3 with each amount of addition shown in Table 3, and mixed by using a Henschel mixer to obtain a toner.

TABLE 3

| | | External additive | | | | | | | | | | | | | |
|---|---|---|---|---|---|---|---|---|---|---|---|---|---|---|---|
| | | First external additive | | | Second external additive | | | Third external additive | | | Four external additive | | | | |
| | Toner particle | Kind | Amount of addition (pbw) | H1 ($m^2/g$) | Kind | Amount of addition (pbw) | H2 ($m^2/g$) | Kind | Amount of addition (pbw) | H3 ($m^2/g$) | Kind | Amount of addition (pbw) | H4 ($m^2/g$) | Total amount of addition (pbw) | Specific surface area of toner ($m^2/g$) |
| Ex. 8 | C1, Bk1 | S1 | 1.1 | 248 | S3 | 0.7 | 49 | TSr | 2.0 | 16 | — | — | — | 3.8 | 2.7 |
| Ex. 9 | C2, Bk2 | S1 | 1.6 | 360 | S3 | 1.2 | 84 | TSr | 2.5 | 20 | — | — | — | 5.3 | 3.9 |
| Ex. 10 | C1, Bk1 | S1 | 0.8 | 180 | S3 | 0.4 | 28 | TSr | 1.3 | 10 | — | — | — | 2.5 | 2.2 |
| Ex. 11 | C1, Bk1 | S1 | 0.8 | 180 | S3 | 0.4 | 28 | TSr | 1.3 | 10 | — | — | — | 2.5 | 2.6 |
| Ex. 12 | C1, Bk1 | S2 | 2.0 | 340 | S4 | 1.3 | 52 | TSr | 2.0 | 16 | — | — | — | 5.3 | 3.0 |
| Ex. 13 | C2, Bk2 | S1 | 1.3 | 293 | S3 | 1.0 | 70 | TSr | 2.0 | 16 | — | — | — | 4.3 | 3.7 |
| Ex. 14 | C1, Bk1 | S2 | 1.1 | 187 | S4 | 0.7 | 28 | TSr | 2.0 | 16 | — | — | — | 3.8 | 2.1 |
| Ex. 15 | C1, Bk1 | S1 | 1.1 | 248 | S3 | 0.7 | 49 | TSr | 2.0 | 16 | T1 | 0.5 | 50 | 4.3 | 3.0 |
| Com. Ex. 15 | C1, Bk1 | S1 | 1.8 | 405 | S3 | 1.4 | 98 | TSr | 2.5 | 20 | — | — | — | 5.7 | 4.1 |
| Com. Ex. 16 | C1, Bk1 | S2 | 0.4 | 68 | S4 | 0.3 | 12 | TSr | 1.3 | 10 | — | — | — | 2.0 | 1.6 |
| Com. Ex. 17 | C1, Bk1 | S1 | 1.8 | 405 | S3 | 1.2 | 84 | TSr | 1.3 | 10 | — | — | — | 4.3 | 4.2 |
| Com. Ex. 18 | C1, Bk1 | S1 | 0.5 | 113 | S3 | 0.4 | 28 | TSr | 2.0 | 16 | — | — | — | 2.9 | 1.8 |
| Com. Ex. 19 | C1, Bk1 | S2 | 1.8 | 306 | S4 | 1.4 | 56 | TSr | 2.5 | 20 | — | — | — | 5.7 | 2.8 |
| Com. Ex. 20 | C1, Bk1 | S1 | 0.5 | 113 | S3 | 0.2 | 14 | TSr | 1.3 | 10 | — | — | — | 2.0 | 2.5 |
| Com. Ex. 21 | C1, Bk1 | S1 | 1.8 | 405 | S3 | 1.4 | 98 | TSr | 2.0 | 16 | T1 | 0.5 | 50 | 5.7 | 3.7 |

In Table 3, the amount of addition (pbw) represents an amount of addition of each external additive agent with respect to 100 parts by weight of toner particles. H1 represents a specific surface area of a first external additive agent per 100 parts by weight of toner particles, H2 represents a specific surface area of a second external additive agent per 100 parts by weight of toner particles, H3 represents a specific surface area of a third external additive agent per 100 parts by weight of toner particles and H4 represents a specific surface area of a fourth external additive agent per 100 parts by weight of toner particles, respectively. The total amount of addition represents an amount of addition of whole additive agent per 100 parts by weight of toner particles. The toner specific surface area represents a BET specific surface area of a toner having toner particles to which external additive agents have been added.

(Evaluation of Heat Resistant Storing Property)

Cyan toner (20 g), obtained by applying external additive agents of the respective Examples and Comparative Examples to cyan toner particles (C1, C2), was put into a glass bottle, and after this had been left at a high temperature of 55° C. for 24 hours, the toner was visually observed, and evaluated. When no aggregated toner particles were observed, or when, although softly aggregated toner particles were slightly observed, the aggregated toner particles were easily separated upon application of a slight force, without causing any problem in practical use, this case was evaluated as O; and when aggregated toner particles were observed, with the aggregated particles being not easily separated, to cause problems in practical use, this case was evaluated as x. Table 4 shows the test results.

(Evaluation of Fogging)

Each toner, obtained by applying external additive agents of the respective Examples and Comparative Examples to cyan toner particles (C1, C2), was loaded into a developing device of a modified machine of a full-color printer LP-3000C (made by Epson K. K.) (whose fixing device is modified to an oil-less fixing device shown in FIG. 1), and 5,000 copies of a print pattern having a B/W ratio of 6% were continuously outputted under N/N environmental conditions (23° C., 45%).

Here, the setting conditions of the fixing device shown in FIG. 1 are explained as follows: The heating roller 11, which had an outer diameter of 40 mm, was provided with an elastic material layer 18 made from foamed silicone rubber having a thickness of 1.5 mm, and a surface layer 19 made from PFA. The pressure roller 12, which had an outer diameter of 35 mm, was provided with an elastic material layer 22 made from foamed silicone rubber having a thickness of 3 mm, and a surface layer 23 made from PFA. A nip (nip width 7 mm), which had a convex shape protruding toward the heating roller side, was formed at a contact portion between the heating roller 11 and the pressure roller 12, and a fixing process was carried out at a temperature of 180° C.

Images, obtained after the continuous outputting operations of 5,000 sheets, were evaluated, and when no fogging occurred in the images, or when, although fogging occurred slightly, no problems were raised in practical use, this case was evaluated as O; and when fogging occurred to cause problems in practical use, this case was evaluated as x. Table 4 shows the test results.

(Evaluation of Cleaning Property)

In the same manner as the above-mentioned evaluation of fogging, with respect to images obtained after the continuous outputting operations of 5,000 sheets, image noises (residual toner, BS, filming) due to defective cleaning processes were confirmed. Those images having no image noise resulting from cleaning processes, or those images having no problems in practical use although slight noise occurred therein, were evaluated as O; and those images having image noise resulting from cleaning processes with problems in practical use as images were evaluated as x. Table 4 shows the test results.

(Color Difference Evaluation Relating to Quantity of Electro Static Charge)

Each cyan toner, obtained by applying external additive agents of the respective Examples and Comparative Examples to cyan toner particles (C1, C2), was loaded into a developing device of a modified machine of a full-color printer LP-3000C (made by Epson K. K.) (whose fixing device was modified to an oil-less fixing device shown in FIG. 1), and after 10 copies of a print pattern having a B/W ratio of 6% had been made under N/N environmental conditions (23° C., 45%), a copy of a white sheet pattern was made, and at this time, cyan toner on a developing roller was sucked so that the quantity of electro static charge of the toner thus sucked was measured by an electrometer, and the weight of the toner was measured; thus, the quantity of electro static charge of the toner was given. In the same manner, the quantities of electro static charge of black toners obtained by applying external additive agents of the respective Examples and Comparative Examples to black toner particles (Bk1, Bk2) were measured. When the absolute value of a difference between quantities of electro static charge of the cyan toner and the black toner was less than 5 $\mu$C/g, this case was evaluated as 0; when it was in a range of not less than 5 $\mu$C/g to less than 10 $\mu$C/g, this case was evaluated as Δ; and when it was not less than 10 $\mu$C/g, this case was evaluated as x. Table 4 shows the test results.

TABLE 4

| | Conditions of External addition | | | | | Color difference evaluation |
|---|---|---|---|---|---|---|
| | Peripheral speed (m/s) | Time (min) | Heat resistant storing property | Fogging | Cleaning property | relating to quantity of electrostatic charge |
| Ex. 8 | 40 | 20 | ○ | ○ | ○ | ○ |
| Ex. 9 | 40 | 20 | ○ | ○ | ○ | ○ |
| Ex. 10 | 40 | 15 | ○ | ○ | ○ | ○ |
| Ex. 11 | 40 | 5 | ○ | ○ | ○ | ○ |
| Ex. 12 | 40 | 30 | ○ | ○ | ○ | ○ |
| Ex. 13 | 40 | 10 | ○ | ○ | ○ | ○ |
| Ex. 14 | 40 | 30 | ○ | ○ | ○ | ○ |
| Ex. 15 | 40 | 20 | ○ | ○ | ○ | ○ |
| Com. Ex. 15 | 40 | 10 | ○ | x | x | ○ |
| Com. Ex. 16 | 40 | 20 | x | ○ | ○ | x |
| Com. Ex. 17 | 40 | 3 | ○ | x | x | ○ |
| Com. Ex. 18 | 40 | 30 | x | ○ | ○ | Δ |
| Com. Ex. 19 | 40 | 30 | ○ | x | x | ○ |
| Com. Ex. 20 | 30 | 5 | x | ○ | ○ | Δ |
| Com. Ex. 21 | 40 | 30 | ○ | x | x | ○ |

What is claimed is:

1. A toner for a full-color image-forming machine, comprising:

toner particles comprising at least a binder resin and a colorant; and an external additive, contained at a content of 2.1–5.5 parts by weight on the basis of 100 parts by weight of the toner particles;

the toner having BET specific surface area of 2.0–4.0 $m^2$/g.

2. A toner of claim 1, in which the toner particles have a volume mean particle size is 3–7 $\mu$m.

3. A toner of claim 1, in which the toner particles are prepared by coagulating particles in a particle dispersion solution in which particles, including at least resin particles, are dispersed, and fusing the particles gained by the coagulation.

4. A toner of claim 1, in which the external additive comprises:

first inorganic fine particles having a BET specific surface area of 150 to 300 $m^2$/g;

second inorganic fine particles having a BET specific surface area of 30 to 100 $m^2$/g; and third inorganic fine particles having a BET specific surface area of 3 to 20 $m_2$/g.

5. A toner of claim 4, in which the first inorganic particles and the second inorganic fine particles are hydrophobic silica and the third inorganic fine particles are strontium titanate.

6. A toner of claim 4, in which hydrophobic titanium oxide the surface of which is surface-treated with a hydrophobizing agent is added externally as fourth inorganic particles.

7. A toner of claim 6, in which hydrophobic titanium oxide has a BET specific surface area of 30 to 250 $m^2$/g.

8. A toner of claim 1, with no charge controlling agent contained.

9. A toner of claim 1, in which the full-color image-forming machine reproduces full color images through the steps, comprising:

carrying out successively a step of transferring toner images formed on an electrostatic latent image supporting member to an intermediate transferring member for each of predetermined colors to form full-color toner images by superposing the toner images of the respective colors on the intermediate transferring member;

transferring the full-color toner images on the intermediate transferring member onto a recording medium; and fixing the full-color toner images on the recording medium.

10. A toner-fixing method, the toner comprising:

toner particles comprising at least a binder resin and a colorant; and an external additive, contained at a content of 2.1–5.5 parts by weight on the basis of 100 parts by weight of the toner particles; and the toner having BET specific surface area of 2.0–4.0 $m^2$/g;

in which a recording medium with toner images formed thereon is passed through a press-contact portion between a heating member constituted of a surface layer of fluorine-containing resin and an elastic material layer and a pressure member or a pressure heat-applying member, that is made in press-contact with the heating member.

11. A toner for a full-color image-forming machine, comprising:

toner particles, comprising at least a binder resin and a colorant, and having a volume mean particle size of 3–7 μm; and an external additive, comprising first inorganic fine particles that are surface-treated by a hydrophobizing agent to have a BET specific surface area of 150 to 300 $m^2/g$ after surface treatment, second inorganic fine particles that are surface-treated by hydrophobizing agent to have a BET specific surface area of 30 to 100 $m^2/g$ after surface treatment, and third inorganic fine particles having a BET specific surface area of 3 to 20 $m^2/g$, and a total specific surface area of the external additive being set to 200 to 530 $m^2/g$ with respect to 100 parts by weight of the toner particles, where in the toner has a BET specific surface area of 2.0–4.0 $m^2/g$.

12. A toner of claim 11, in which the toner particles are prepared by coagulating particles in a particle dispersion solution in which particles, including at least resin particles, are dispersed, and fusing the particles gained by the coagulation.

13. A toner of claim 11, in which the first inorganic fine particles have a specific surface area (H1) of 170 to 430 $m^2/g$ on the basis of 100 parts by weight of the toner particles;

the second inorganic fine particles have a specific surface (H2) area of 20 to 110 $m^2/g$ on the basis of 100 parts by weight of the toner particles; and the third inorganic fine particles have a specific surface (H3) area of 8 to 22 $m^2/g$ on the basis of 100 parts by weight of the toner particles.

14. A toner of claim 11, in which the first inorganic particles are first hydrophobic silica, the second inorganic fine particles are second hydrophobic silica, and the third inorganic fine particles are strontium titanate.

15. A toner of claim 11, in which the first hydrophobic silica is silica which surface-treated with a hydrophobizing agent and has a mean primary particle size of 5–18 nm, the second hydrophobic silica is silica which surface-treated with a hydrophobizing agent and has a mean primary particle size of 18–50 nm, and strontium titanate has a mean primary particle size of 100–800 nm.

16. A toner of claim 11, in which hydrophobic titanium oxide is added externally as fourth inorganic particles, the hydrophobic titanium is prepared by surface-treating titanium oxide having a mean primary particle size of 10–80 nm with a hydrophobizing agent to have a BET specific surface area of 30 to 250 $m^2/g$ after surface treatment.

17. A toner of claim 16, in which the hydrophobic titanium has a specific surface area (H4) of 5 to 100 $m^2/g$ on the basis of 100 parts by weight of the toner particles.

18. A toner for a nonmagnetic monocomponent developer used in a full-color image-forming machine, comprising:

toner particles, comprising at least a binder resin and a colorant, and having a volume mean particle size of 3–7 μm; and an external additive, comprising first inorganic fine particles that are surface-treated by a hydrophobizing agent to have a BET specific surface area of 150 to 300 $m^2/g$ after surface treatment, second inorganic fine particles that are surface-treated by a hydrophobizing agent to have a BET specific surface area of 30 to 100 $m^2/g$ after surface treatment, and third inorganic fine particles having a BET specific surface area of 3 to 20 $m^2/g$, and a total specific surface area of the external additive being set to 200 to 530 $m^2/g$ with respect to 100 parts by weight of the toner particles, where in the toner has a BET specific surface area of 2.0–4.0 $m^2/g$.

19. A toner of claim 11, in which the full-color image-forming machine reproduces full color images through the steps, comprising:

carrying out successively a step of transferring toner images formed on an electrostatic latent image supporting member to an intermediate transferring member for each of predetermined colors to form full-color toner images by superposing the toner images of the respective colors on the intermediate transferring member;

transferring the full-color toner images on the intermediate transferring member onto a recording medium; and fixing the full-color toner images on the recording medium.

20. A toner-fixing method, the toner comprising:

toner particles, comprising at least a binder resin and a colorant, and having a volume mean particle size of 3–7 μm; and an external additive, comprising:

first inorganic fine particles that are surface-treated by a hydrophobizing agent to have a BET specific surface area of 150 to 300 $m^2/g$ after surface treatment, second inorganic fine particles that are surface-treated by a hydrophobizing agent to have a BET specific surface area of 30 to 100 $m^2/g$ after surface treatment, and third inorganic fine particles having a BET specific surface area of 3 to 20 $m^2/g$, and a total specific surface area of the external additive being set to 200 to 530 $m^2/g$ with respect to 100 parts by weight of the toner particles, where in the toner has a BET specific surface area of 2.0–4.0 $m^2/g$.

in which a recording medium with toner images formed thereon is passed through a press-contact portion between a heating member constituted of a surface layer of fluorine-containing resin and an elastic material layer and a pressure member or a pressure-heat-applying member, that is made in press-contact with the heating member.

* * * * *